US006739060B1

(12) United States Patent
Huang

(10) Patent No.: US 6,739,060 B1
(45) Date of Patent: May 25, 2004

(54) SAWING MACHINE WITH DUSTPROOF ASSEMBLY

(75) Inventor: Peter Huang, Taichung (TW)

(73) Assignee: Durq Machinery Corp., Taichung (TW)

( * ) Notice: Subject to any disclaimer, the term of this patent is extended or adjusted under 35 U.S.C. 154(b) by 0 days.

(21) Appl. No.: 10/424,930

(22) Filed: Apr. 29, 2003

(51) Int. Cl.[7] ..... B27B 9/00
(52) U.S. Cl. ..... 30/391; 125/13.01
(58) Field of Search ..... 30/391, 390, 388; 125/13.01; 83/478

(56) References Cited

U.S. PATENT DOCUMENTS 4,685,214 A * 8/1987 Shearon et al. ..... 30/391
5,724,875 A * 3/1998 Meredith et al. ..... 83/397
5,862,594 A * 1/1999 Soderqvist ..... 30/122
5,873,282 A * 2/1999 Dibbern et al. ..... 74/421 A
6,561,063 B1 * 5/2003 Mulford et al. ..... 82/128
2003/0196649 A1 * 10/2003 Vidmore ..... 125/13.01

* cited by examiner

*Primary Examiner*—Douglas D. Watts
(74) *Attorney, Agent, or Firm*—Bacon & Thomas, PLLC

(57) ABSTRACT

A sawing machine has a casing, a moveable cover and a saw blade both pivotally mounted inside the casing. Two block rings are respectively mounted at two lateral sides of a pivoted portion of the moveable cover for preventing sawing chips generated by the saw blade sawing a workpiece in a sawing procedure from entering the pivoted portion of the moveable cover.

7 Claims, 7 Drawing Sheets

SAWING MACHINE WITH DUSTPROOF ASSEMBLY

BACKGROUND OF THE INVENTION

1. Field of the Invention

The present invention relates generally to a machine tool, and more particularly to a sawing machine having an assembly for dustproof.

2. Description of the Related Art

FIG. 1 shows a conventional sawing machine mainly having a casing 1, a transmission assembly 2, a movable cover 3 and a saw blade 4. The transmission assembly 2 has a motor 2*a* mounted at an outer side of the casing 1, a bearing mount 2*b* mounted at an inner side of the casing 1 and a transmission shaft 2*c* running through the bearing mount 2*a*, wherein the bearing mount 2*b* has an axle 2*d* projected out, the movable cover 3 has an annular rim 3*a* and an arched block plate 3*b* to engage the rim 3*a* with the axle 2*d* so that the movable cover 3 swings with the axle 2*d* to be the center of rotation. The saw blade 4 connects with the transmission shaft 2*c* and has a part thereof covered by the block plate 3*b*. A separating device 5 is provided in between the movable cover 3 and saw blade 4 to keep the saw blade 4 running smoothly. When the sawing machine is cutting a specific object A, as shown in FIG. 2, the movable cover 3 has its front end in contact with the object A and moves along with it. In the meantime of the object A running forwardly, the movable cover 3 swings backwardly so that the movable cover 3 always can block the chips of the object A being sawn.

It is always occurred in the conventional sawing machine that the chips run into the space between the rim 3*a* and the axle 2*d* and are accumulated therein to make the movable cover 3 can not swing smoothly. Beside that, the movable cover was made of aluminum so that while a metal object was sawn by the machine, the metal chips accumulated in between the rim and the axle damage the movable cover frequently.

SUMMARY OF THE INVENTION

The primary objective of the present invention is to provide a sawing machine having a dustproof assembly to block the sawing chips so that the movable cover always works correctly in sawing procedures.

According to the objective of the present invention, a sawing machine comprises a casing having a chamber therein, an axle hole at a side thereof and an opening at a bottom thereof. Both of the axle hole and the opening communicate with the chamber. A transmission assembly has a bearing mount mounted at an inner side of the casing having a base board and an axle projected from a side of the base board, a transmission shaft running through the bearing mount and the axle hole and a power resource for driving the transmission shaft to rotate. A movable cover has an annular rim and a block plate, wherein the rim has an inner annular face, an inner face and an outer face and is engaged with the axle of the bearing mount so that the movable cover swings around the axle which serves as a center of rotation. A first block ring is installed in between the bearing mount and the movable cover, wherein the first block ring is attached to the base board of the bearing mount and the rim of the movable cover respectively. A block device is provided at an outer side of the movable cover and has a mask and a second block ring, wherein the mask has a first hole for the transmission shaft running therethrough and the second block ring has opposite sides attached to the outer face of the rim of the movable cover and the mask respectively, and a saw blade is fastened at a distal end of the transmission shaft and is located at an outer side of the block device, wherein the saw blade has a part thereof extruded out of the casing via the opening and the extruded part thereof are covered by the block plate.

DETAILED DESCRIPTION OF THE INVENTION

Figure 1:
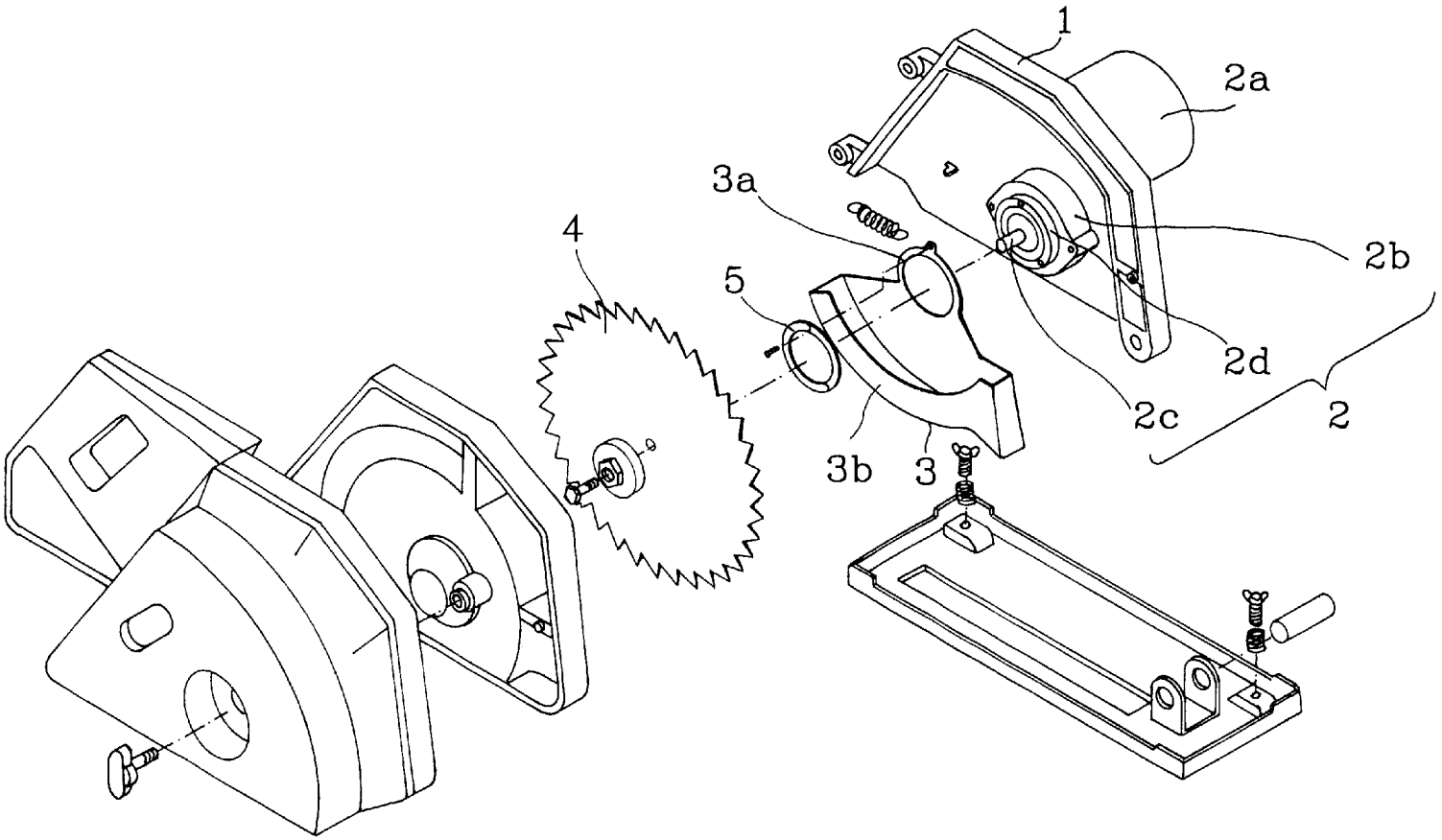
FIG. 1 PRIOR ART
FIG. 1 is an exploded view of a conventional sawing machine.
Figure 2:
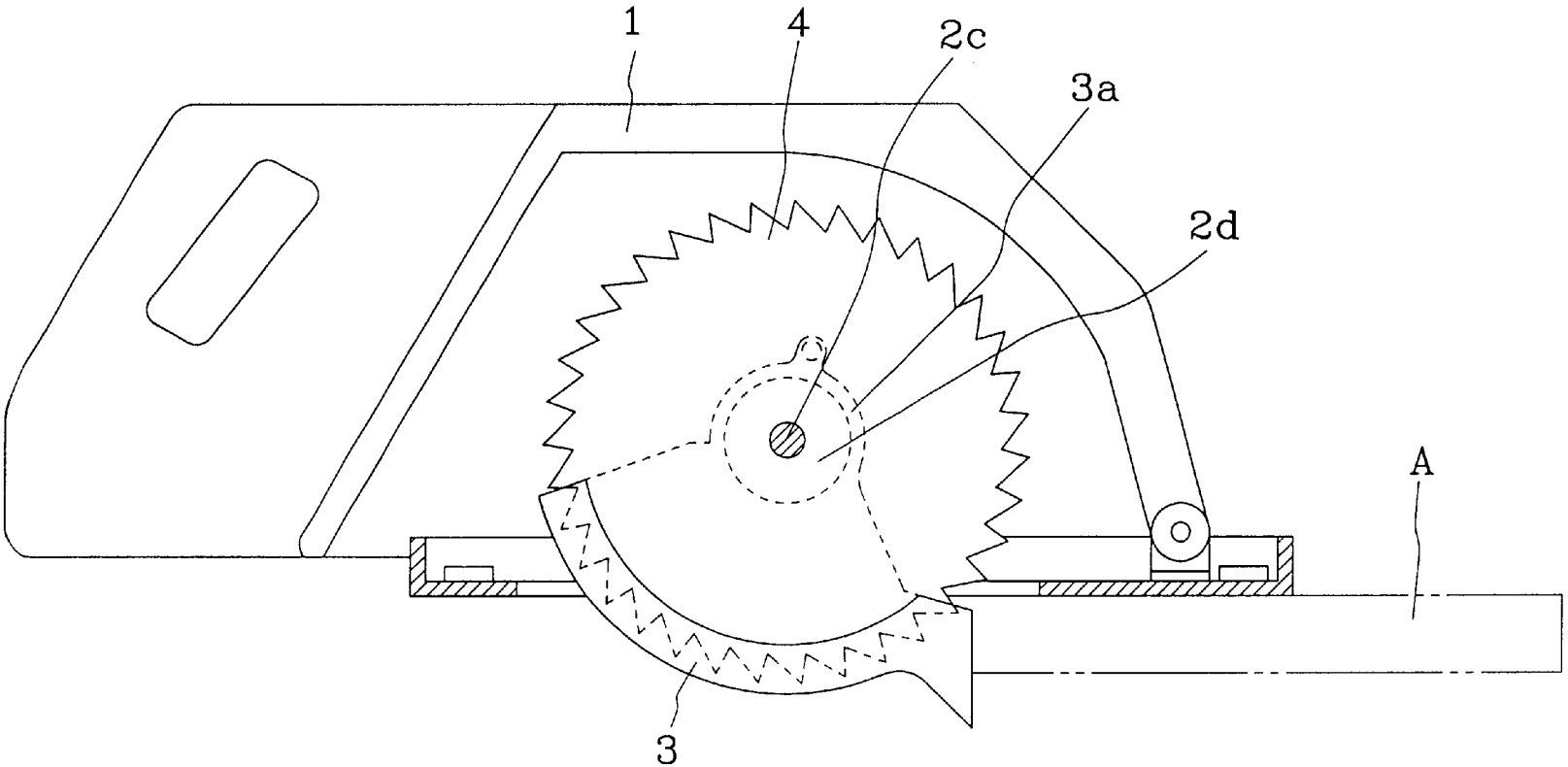
FIG. 2 PRIOR ART
FIG. 2 is a front view of the conventional sawing machine, showing a specific object being sawn.

As shown in FIGS. from FIG. 3 to FIG. 6, a sawing machine 100 of the preferred embodiment of the present invention mainly comprises a casing 10, a transmission assembly 20, a sheath 30, a first block ring 40, a movable cover 50, an annular piece 60, a block device 70 and a saw blade 80.

The casing 10 has a chamber 11 therein, an axle hole 12 at an inner side and an opening 13 at a bottom, and both of the axle hole 12 and the opening 13 are communicated with the chamber 11. The casing 10 further has two thread holes 14 beside the axle hole 12.

The transmission assembly 20 includes a bearing mount 21, a transmission shaft 22, a gear 23 for deceleration and a motor 24 as a power resource. The bearing mount 21 has a base board 211, an axle 212 projected from a side of the base board 211, three thread holes 213 at a distal end of the axle 212 and two through holes 214 at the base board 211. The bearing mount 21 is firmly secured on the casing 10 via two bolts 25 running through the through holes 214 and screwed into the thread holes 14 on the casing 10. The transmission shaft 22 runs through the bearing mount 21 and the axle hole 12. The gear 23 connects with the transmission shaft 22 at an end thereof and is received in the axle hole 12. The motor 23 drives the transmission shaft 22 rotating via the gear 23.

The sheath 30 is made of metal having a ring portion 31 with a diameter substantially equal to a diameter of the axle 212 and a flange portion 32 radially projected from an end of the ring portion 31.

Figure 3:
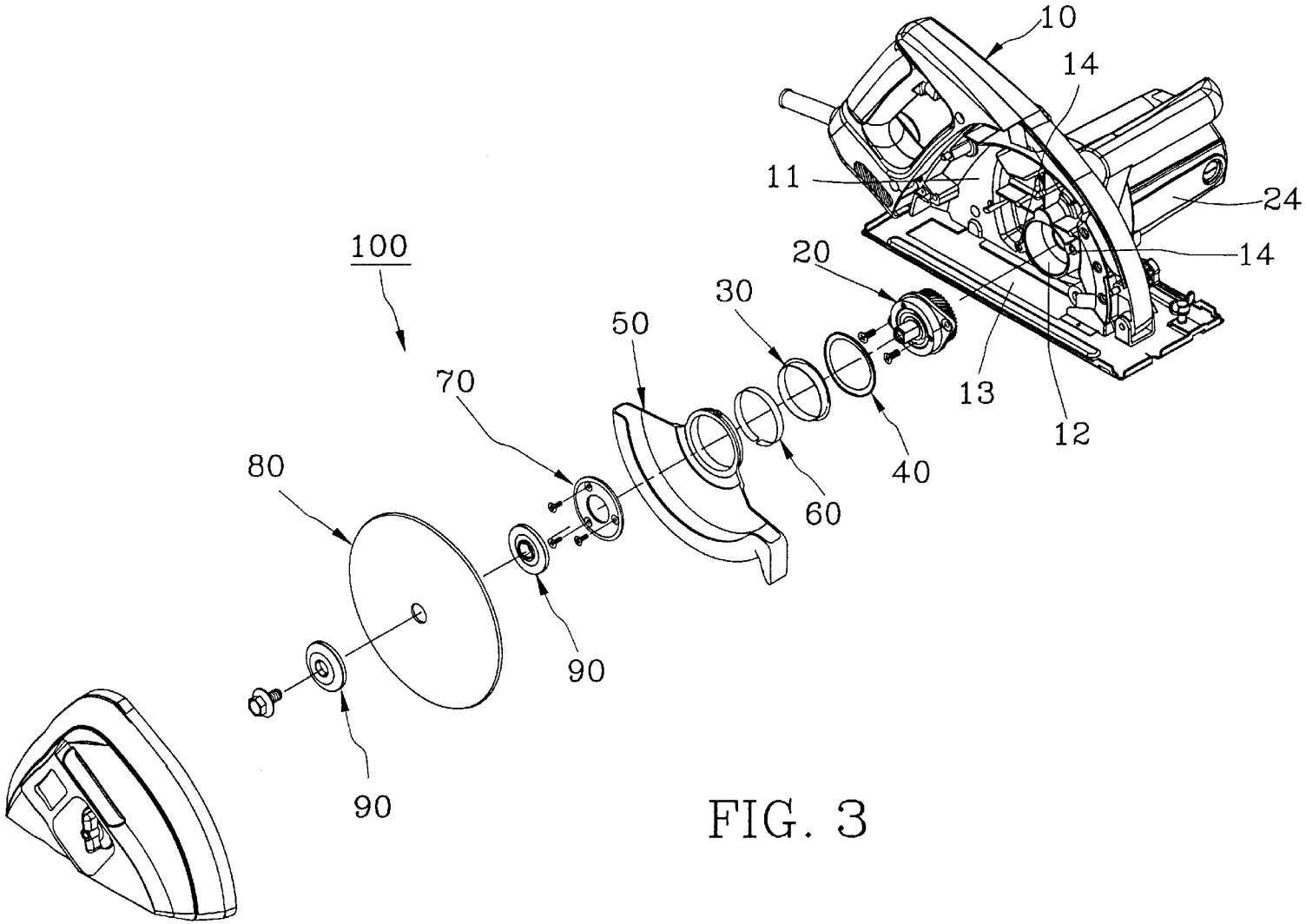
FIG. 3 is an exploded view of a preferred embodiment of the present invention.
Figure 4:
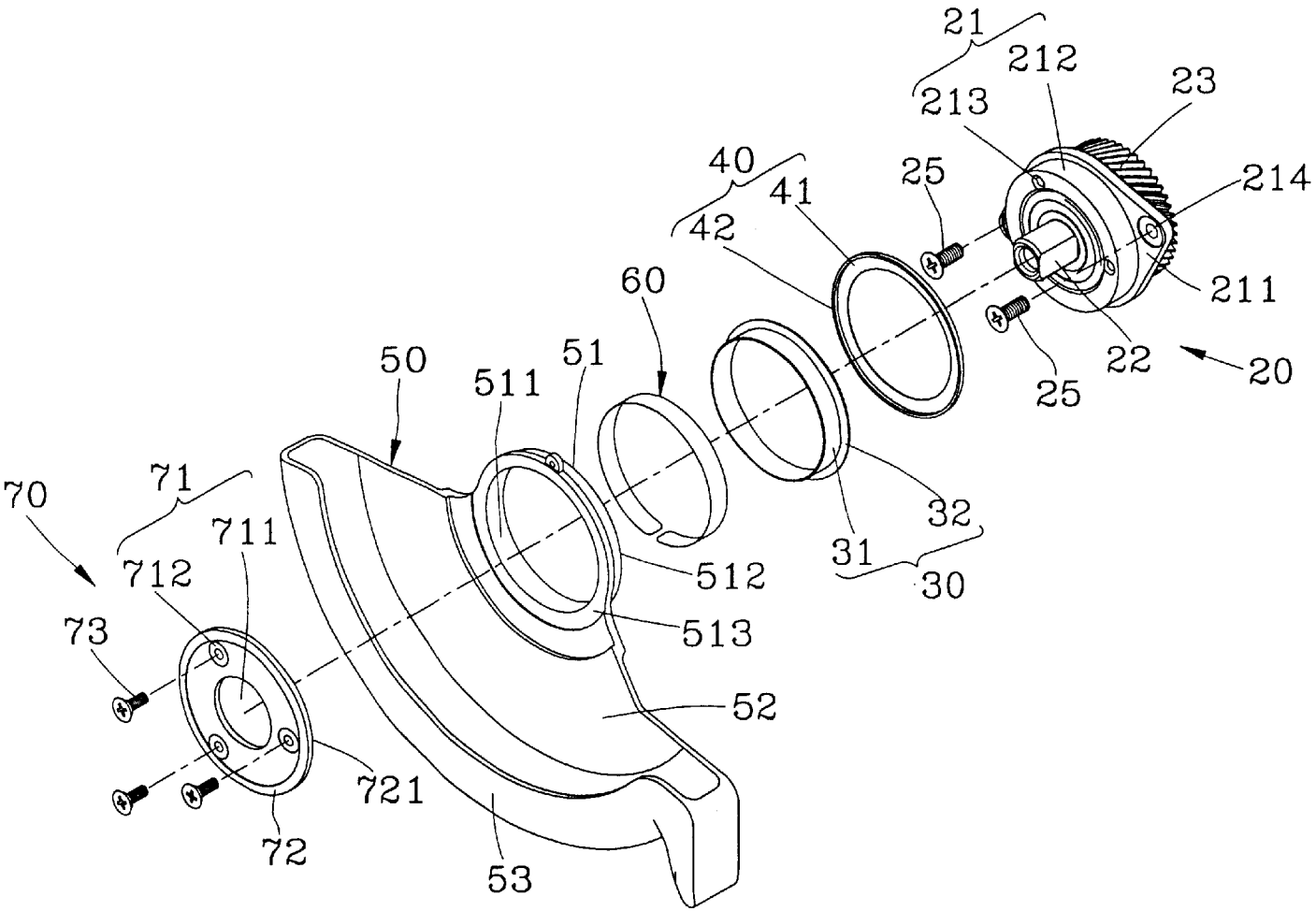
FIG. 4 is an enlarged exploded view of partial elements of the preferred embodiment of the present invention.
Figure 6:
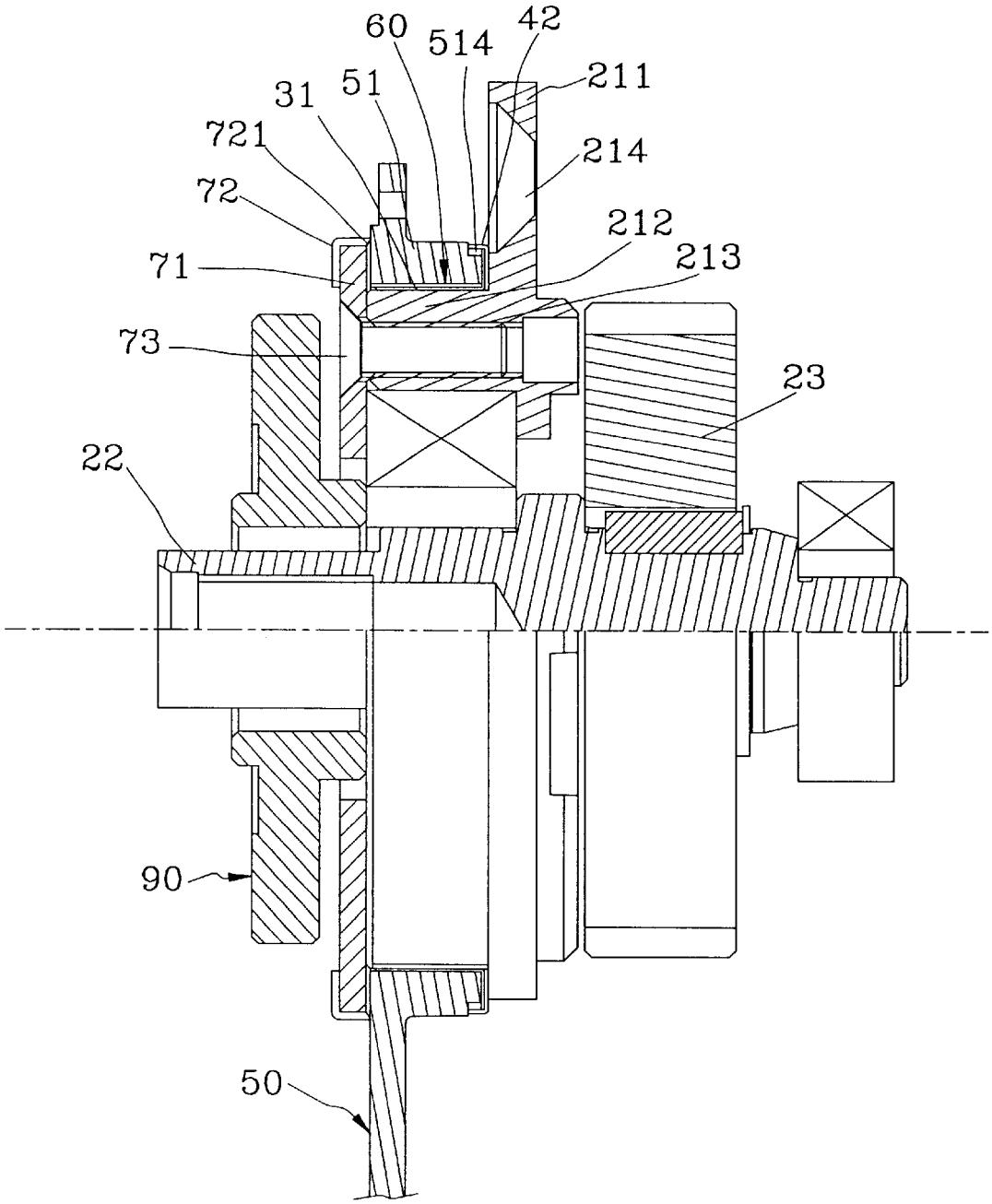
FIG. 6 is a sectional view of FIG. 5.

The first block ring 40 is made of rubber having an annular portion 41 and a lip portion 42 projected from an edge of the annular portion 41 for dustproof. As shown in FIG. 3 and FIG. 6, the first block ring 40 is installed in between the bearing mount 21 and the sheath 30. The ring portion 31 of the sheath 30 is engaged with the axle 212. The flange portion 32 is attached to the base board 211 by the annular portion 41 of the first block ring 40 pressing it. The lip portion 42 of the first block ring 40 faces outwardly.

The movable cover 50 is made of aluminum having an annular rim 51, a side plate 52 and an arched block plate 53, wherein the annular rim 51 has an inner annular face 511 , an inner face 512, an outer face 513 and a step portion 514 on the outer face 513. The annular piece 60 is made of metal initially installed in the annular rim 51 as shown in FIG. 6. The annular rim 51 is engaged with axle 212 in the bearing mount 21 and the annular piece 60 is located at between the inner annular face 511 of the annular rim 51 and the ring portion 31 of the sheath 30. The lip portion 42 of the first block ring 40 is attached to the step portion 514 so that the movable cover 50 swings with the axle 212 to be a center of rotation.

Figure 5:
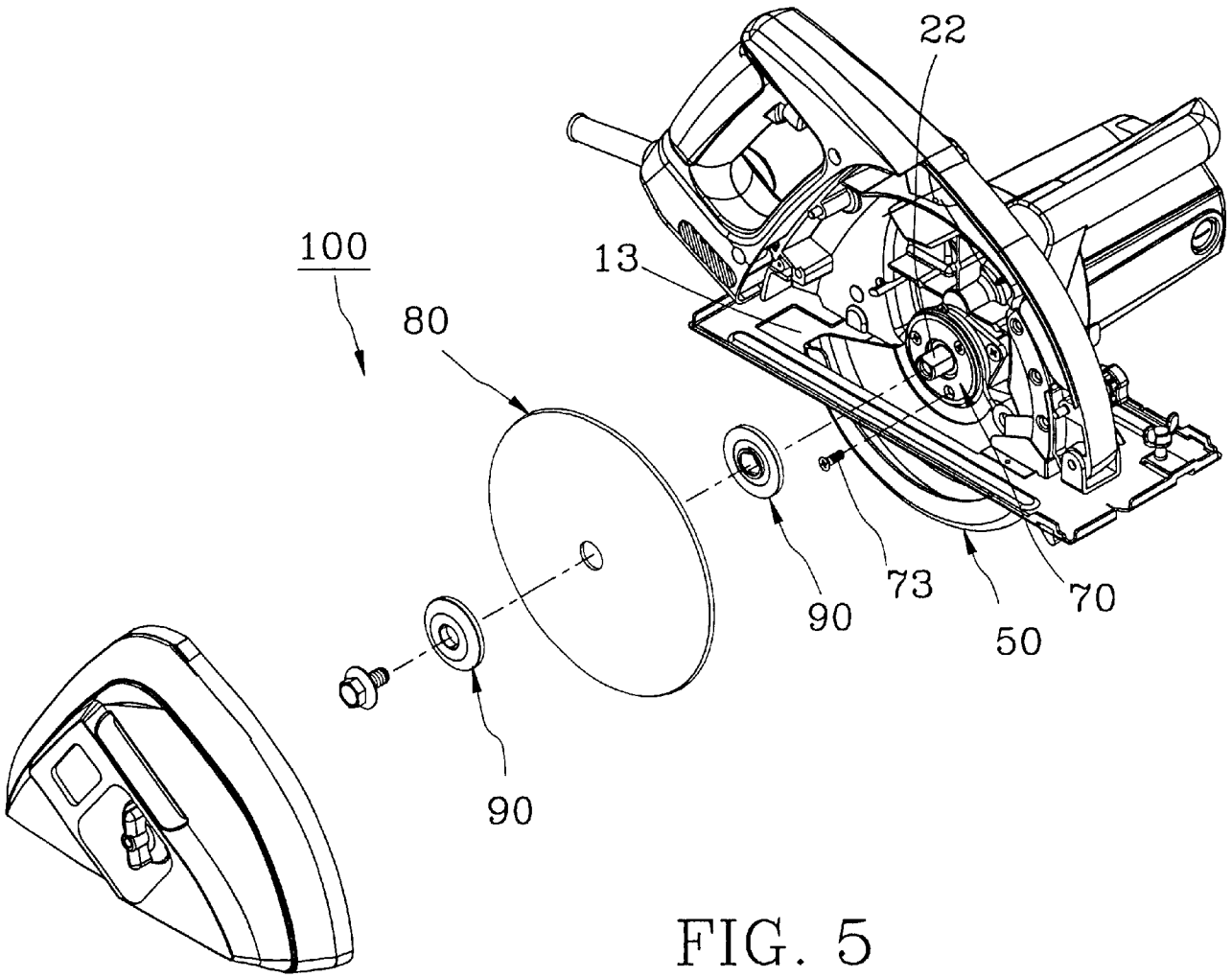
FIG. 5 is a perspective of the elements shown in FIG. 4 being assembled.

The block device 70 consists of a mask 71 and a second block ring 72, wherein the mask 71 has a first hole 711 and three second holes 712 and the second block ring 72 is a rubber ring covering an edge of the mask 71. The second block ring 72 has a lip portion 721 at the edge of the mask 71 as shown in FIG. 5. The block device 70 is firmly secured at an outer side of the movable cover 50 with the lip portion 721 attached to the outer face 513 of the annular rim 51 via three bolts 73 running through second holes 712 and screwed into the thread holes 213 of the bearing mount 21 respectively. The transmission shaft 22 is extruded out of the block device 70 via the first hole 711 as shown in FIG. 6. It has to be mentioned that the assembled block device 70 does not interfere with the motion of the movable cover 50.

The saw blade 80 connects with the transmission shaft 22 at an end extruded out via the first hole 711. The saw blade 80 has two separating device 90 to keep the saw blade 80 running smoothly. The saw blade 80 has a part thereof extruded out of the casing 10 via the opening 13 and the extruded part thereof is covered by the block plate 53.

The main character of the present invention is to provide the rubber first and second block rings 40 and 72, as shown in FIG. 6, at between the movable cover 50 and the axle 212 which the lip portions 42 and 721 are attached to opposite sides of the annular rim 51 of the movable cover 50 so that chips of an object sawn by the saw blade 80 are blocked thereby under a condition of without interfering with the motions of the saw blade 80 and the movable cover 50. An alternate structure is that rubber washers (not shown) are installed in between the opposite sides of the annular rim 51, the base board 211 and the mask 71 respectively. Another alternate structure is that the sheath 30 made of a metal piece and the annular piece 60 are provided in between the annular rim 51 and the axle 212. The capacities of smaller friction and wearproof of the sheath 30 and the annular piece 60 make movable cover 50 swinging more smoothly and prevent the portion of the movable cover 50 adjacent to the axle 212 from wearing.

Figure 7:
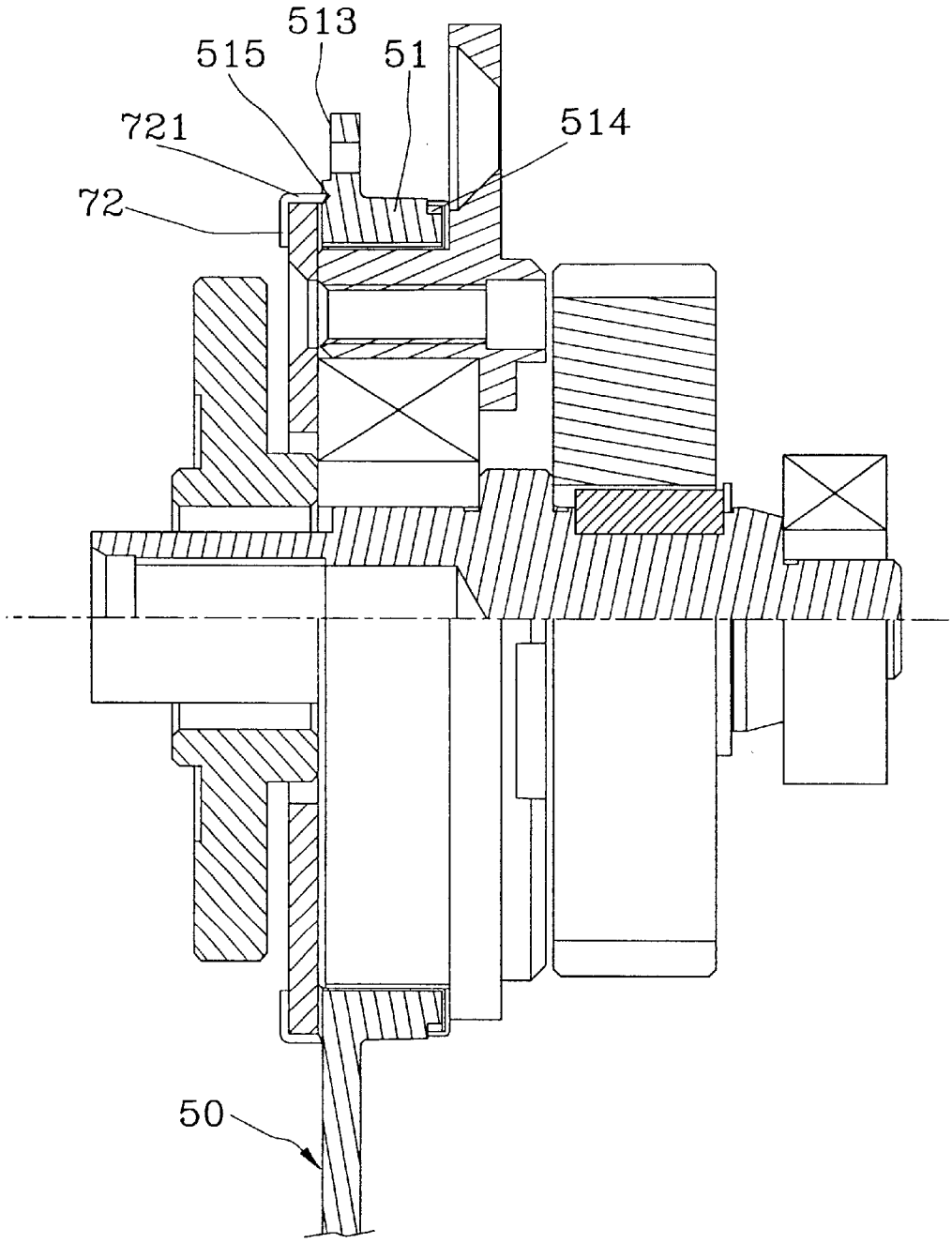
FIG. 7 is similar to FIG. 6, showing a slot on the outer side of the rim of the movable cover.

As shown in FIG. 7, the movable cover 50 is provided with a slot 515 at the outer face 513 of the annular rim 51 to receive the lip portion 721 of the second block ring 72 therein that make the sawing machine of the present invention having more capacity of blocking the sawing chips.

What is claimed is:

1. A sawing machine, comprising:

a casing having a chamber therein, an axle hole at a side thereof and an opening at a bottom thereof, wherein both of the axle hole and the opening are communicated with the chamber;

a transmission assembly having a bearing mount mounted at an inner side of the casing having a base board and an axle projected from a side of the base board, a transmission shaft running through the bearing mount and the axle hole and a power resource for driving the transmission shaft to rotate;

a movable cover having an annular rim and a block plate, wherein the rim has an inner annular face, an inner face and an outer face and the rim is engaged with the axle of the bearing mount so that the movable cover swings around the axle which serves as a center of rotation;

a first block ring installed in between the bearing mount and the movable cover, wherein the first block ring is attached to the base board of the bearing mount and the rim of the movable cover respectively;

a block device provided at an outer side of the movable cover having a mask and a second block ring, wherein the mask has a first hole for the transmission shaft running therethrough and the second block ring is attached to the outer face of the rim of the movable cover and the mask respectively, and a saw blade fastened at a distal end of the transmission shaft and located at an outer side of the block device, wherein the saw blade has a part thereof extruded out of the casing via the opening and the extruded part thereof are covered by the block plate.

2. The sawing machine as defined in claim 1, further comprising a sheath having a ring portion and a flange portion to be engaged with the axle and the first block ring having an annular portion and a lip portion, wherein the annular portion is attached to the flange portion, the annular portion is attached to the base board and the lip portion is attached to the inner face of the rim of the movable cover.

3. The sawing machine as defined in claim 2, wherein the movable cover further has a step portion at the inner face of the rim to be attached to the lip portion of the first block ring.

4. The sawing machine as defined in claim 2, further comprising an annular piece installed in between the ring portion of the sheath and the inner face of the rim of the movable cover.

5. The sawing machine as defined in claim 1, wherein the second block ring of the block device has an annular lip portion at an edge of the mask and the axle of the bearing mount has at least two thread holes at an end thereof and the mask has at least two second holes corresponding to the thread holes of the axle so that at least two bolts run through the second hole and are screwed into the thread holes respectively to make the lip portion of the second block ring attached to the outer face of the rim of the movable cover.

6. The sawing machine as defined in claim 5, wherein the movable cover has a slot at the outer face of the rim and the lip portion of the second block ring is received in the slot.

7. The sawing machine as defined in claim 1, wherein the first and second block rings are made of rubber.

* * * * *